United States Patent [19]

Giles

[11] Patent Number: 5,065,975

[45] Date of Patent: Nov. 19, 1991

[54] MAIL BOX SUPPORT APPARATUS

[76] Inventor: Homer Giles, 1434 E. Sunnyview, Visalia, Calif. 93291

[21] Appl. No.: 610,164

[22] Filed: Nov. 5, 1990

[51] Int. Cl.[5] ..... F16M 13/00

[52] U.S. Cl. ..... 248/545; 232/39; 248/146; 248/156

[58] Field of Search ..... 248/156, 146, 145, 530, 248/532, 533, 521; 232/38, 39

[56] References Cited

U.S. PATENT DOCUMENTS

| | | | |
|---|---|---|---|
| 1,545,203 | 7/1925 | Schaefer, Jr. | 248/146 X |
| 1,994,186 | 3/1935 | Anderson | 232/39 |
| 2,554,887 | 5/1951 | Triarico | 248/156 X |
| 3,762,672 | 10/1973 | Tabbert | 248/146 |
| 3,809,346 | 5/1974 | Jackson | 248/530 |
| 3,881,650 | 5/1975 | Schmidt | 248/145 X |
| 4,242,822 | 1/1981 | Black | 248/530 X |
| 4,402,166 | 9/1983 | Wortham, Jr. | 248/156 |
| 4,709,853 | 12/1987 | Hahn | 248/146 X |
| 4,717,110 | 1/1988 | Fohrman | 248/533 |
| 4,850,564 | 7/1989 | Padin | 248/533 |
| 4,951,905 | 8/1990 | Bronson et al. | 232/39 X |

FOREIGN PATENT DOCUMENTS

| | | | |
|---|---|---|---|
| 1557852 | 1/1969 | France | 248/530 |

*Primary Examiner*—David L. Talbott
*Attorney, Agent, or Firm*—Leon Gilden

[57] ABSTRACT

An apparatus providing securement and mounting of a mail box, arranged with a vertical post threadedly mounted to an upper plate, with the upper plate securing a single or a plurality of mail box members thereon. The lower end of the post is threadedly received with a socket, the socket integrally and orthogonally mounted to a lower support plate, with the lower support plate mounting a plurality of spike members projecting orthogonally downwardly from the lower support plate for securement within the ground.

1 Claim, 4 Drawing Sheets

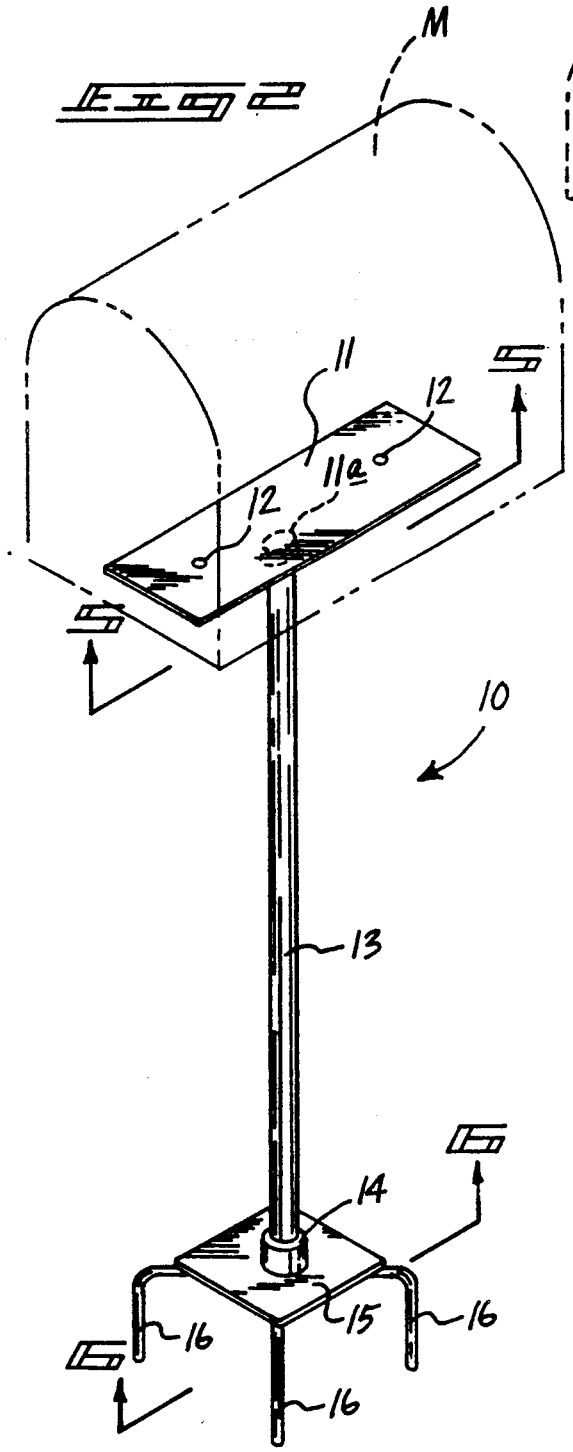
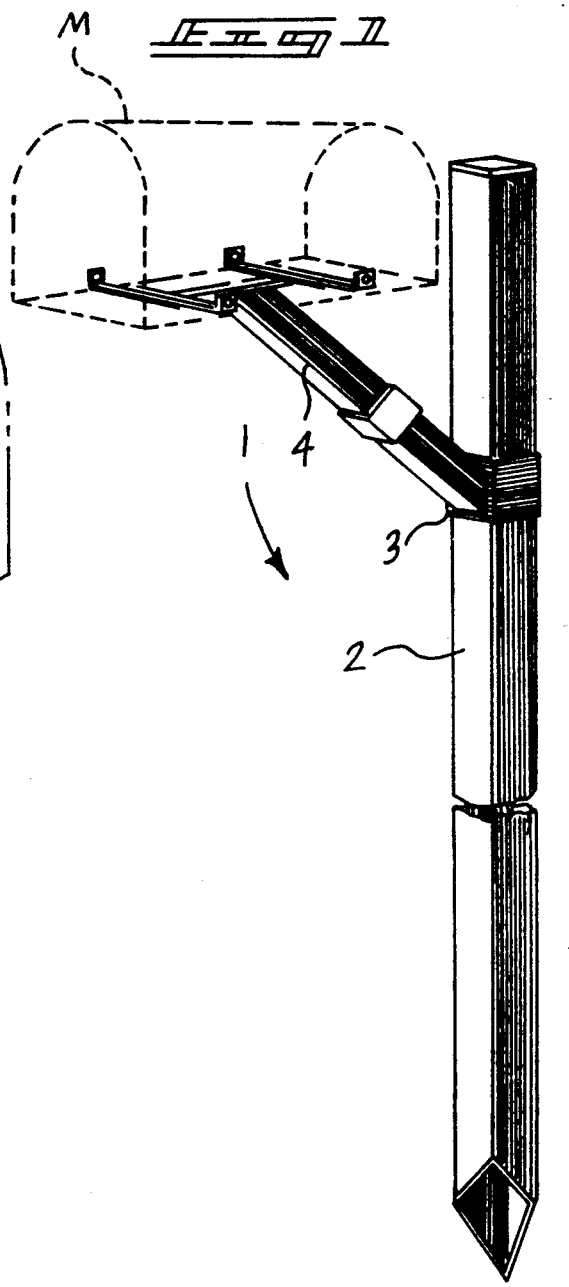
PRIOR ART

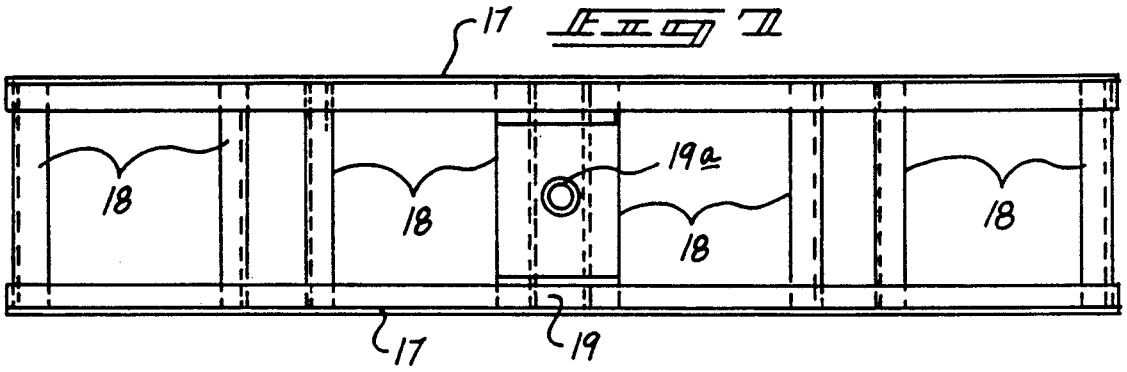
Fig 7
Fig 8
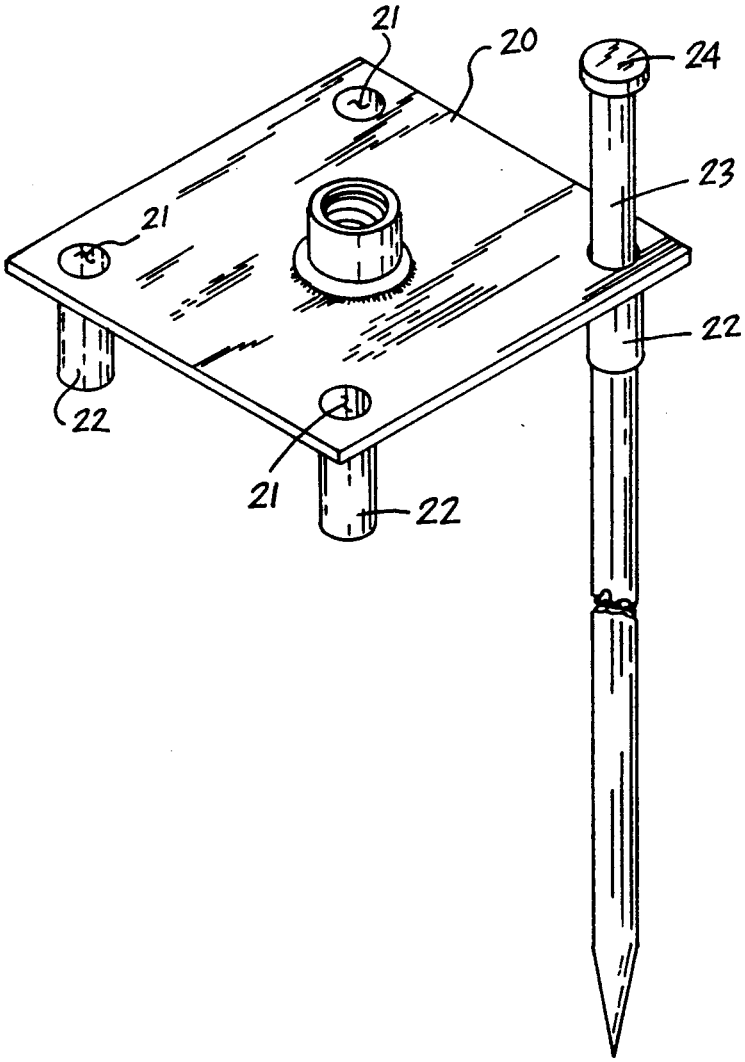
Fig 9
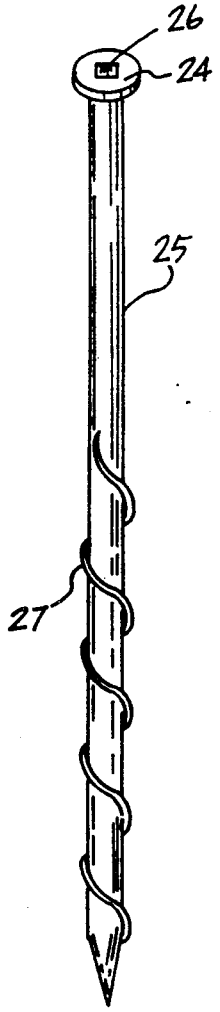

MAIL BOX SUPPORT APPARATUS

BACKGROUND OF THE INVENTION

1. Field of the Invention

The field of invention relates to mail box support arrangements, and more particularly pertains to a new and improved mail box support apparatus wherein the same is readily and securedly mounted and projected within the ground for securement of an associated mail box.

2. Description of the Prior Art

Mounting and securement of various mail box arrangements is well known in the prior art to provide a fixed arrangement for the securing of mail boxes, particularly in a rural environment. Such prior art apparatus may be found in U.S. Pat. No. 4,213,460 to Hall wherein a vertical post includes a collar overlying the post and adjustably positioned in a vertical orientation relative to the post for positioning a mail box relative to the post in use.

U.S. Pat. No. 4,792,088 to Bonnell sets forth a mail box utilizing a medial portion, including a spring member to permit deflection of the post and return to an original position.

U.S. Pat. No. 4,588,123 to Plew sets forth a mail box member utilizing a hollow support base and mail box integrally molded into a unitary structure.

U.S. Pat. No. 4,709,853 to Hahn sets forth a platform for mounting a mail box, with the rails of the organization adjustably arranged to secure the mail box therebetween.

U.S. Pat. No. 4,236,665 to Glass sets forth a mail box post bracket arranged with reinforcing ribs to provide structural integrity to the organization.

As such, it may be appreciated that there continues to be a need for a new and improved mail box support apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of mail box support apparatus now present in the prior art, the present invention provides a mail box support apparatus wherein the same permits the organization to include a lower support plate and associated projectile members that may be directed with an underlying support surface, such as the ground. As such, the general purpose of the present invention, which will be described subsequently in greater detail, is to provide a new and improved mail box support apparatus which has all the advantages of the prior art mail box support apparatus and none of the disadvantages.

To attain this, the present invention provides a securement and mounting of a mail box, arranged with a vertical post threadedly mounted to an upper plate, with the upper plate securing a single or a plurality of mail box members thereon. The lower end of the post is threadedly received within a socket, the socket integrally and orthogonally mounted to a lower support plate, with the lower support plate mounting a plurality of spike members projecting orthogonally downwardly from the lower support plate for securement within the ground.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved mail box support apparatus which has all the advantages of the prior art mail box support apparatus and none of the disadvantages.

It is another object of the present invention to provide a new and improved mail box support apparatus which may be easily and efficiently manufactured and marketed.

It is a further object of the present invention to provide a new and improved mail box support apparatus which is of a durable and reliable construction.

An even further object of the present invention is to provide a new and improved mail box support apparatus which is susceptible of a low cost of manufacture with regard to both materials and labor, and which accordingly is then susceptible of low prices of sale to the consuming public, thereby making such mail box support apparatus economically available to the buying public.

Still yet another object of the present invention is to provide a new and improved mail box support apparatus which provides in the apparatuses and methods of the prior art some of the advantages thereof, while simultaneously overcoming some of the disadvantages normally associated therewith.

Still another object of the present invention is to provide a new and improved mail box support apparatus wherein the same may be readily and conveniently mounted within the ground surface by utilizing spike members for projecting into the ground for securement of the overlying post organization.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art mail box support apparatus.

FIG. 2 is an isometric illustration of the instant invention.

FIG. 7 is an orthographic bottom view of the modified upper support plate utilized by the instant invention.

FIG. 8 is an isometric illustration of a modified lower support plate utilized by the instant invention.

FIG. 9 is an isometric illustration of a modified spike member utilized by the instant invention.

DESCRIPTION OF THE PREFERRED EMBODIMENT

Figure 3:
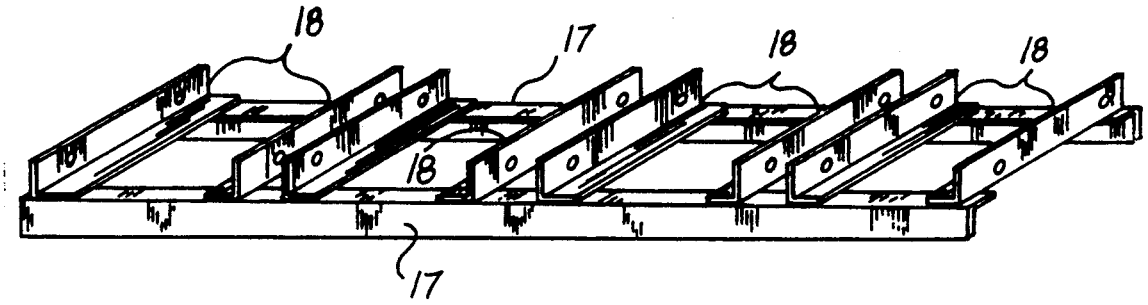
FIG. 3 is an isometric illustration of an upper mounting plate utilized by the instant invention.
Figure 4:
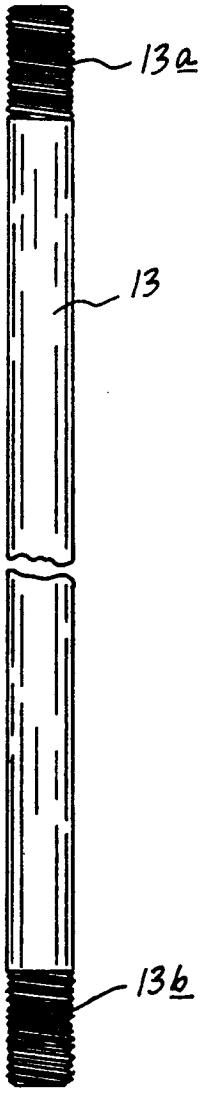
FIG. 4 is an orthographic view, taken in elevation, of the mounting post utilized by the instant invention.
Figure 5:
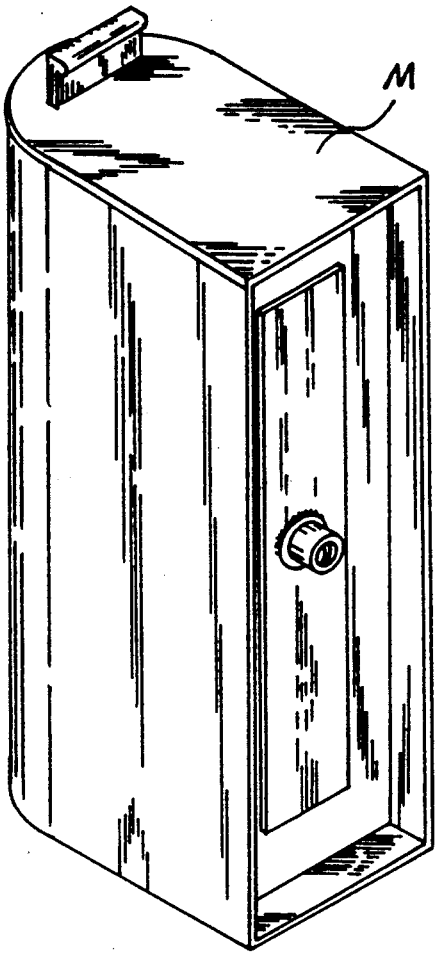
FIG. 5 is an isometric bottom view of a typical mount utilized by the instant invention secured to an associated mail box.

With reference now to the drawings, and in particular to FIGS. 1 to 9 thereof, a new and improved mail box support apparatus embodying the principles and concepts of the present invention and generally designated by the reference numeral 10 will be described.

FIG. 1 illustrates a prior art mail box support apparatus 1, wherein a vertical post 2 mounts a collar 3 in an adjustable relationship relative to the post 2, with a beam member 4 mounting a mail box "M" thereon, in a manner as set forth in U.S. Pat. No. 4,213,560.

Figure 6:
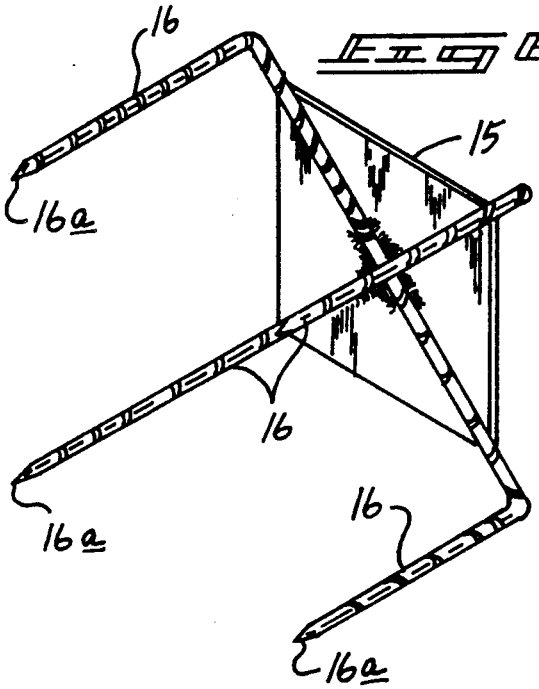
FIG. 6 is an isometric illustration of the lower support plate and projecting spikes utilized by the instant invention.

More specifically, the mail box support apparatus 10 of the instant invention essentially comprises an upper mounting plate 11, including a plurality of mounting apertures 12 directed through the mounting plate for securement of the mail box "M" thereto. The upper mounting plate includes an upper internally threaded socket 11*a* (see FIGS. 2 and 5) for securement of the mail box "M" thereto. A post member 13 includes an upper threaded end 13*a* and a lower threaded end 13*b*, with the upper threaded end 13*a* threadedly secured and positioned within the upper internally threaded socket 11*a*. The lower threaded end 13*b* is threadedly received within an internally threaded lower socket 14 orthogonally and fixedly mounted to an upper surface of a lower support plate 15. The support plate 15 includes a series of spike members 16 orthogonally projecting downwardly from the bottom surface of the support plate 15 spaced apart at ninety degree intervals and projecting beyond the support plate 15 for securement within an underlying ground surface to expose each spike member 16 for receiving impact from a hammer or the like for directing each spike member into the underlying ground surface utilizing the lower pointed end 16*a* for piercing into the ground, in a manner as illustrated in FIG. 6.

FIGS. 3 and 7 illustrate a modified upper mounting plate, including spaced parallel rails 17 coextensively arranged relative to one another, including plural pairs of "L" shaped flange members 18. The flange members 18 include upstanding vertical plates, with apertures therethrough for receiving securement members to secure an associated mail box "M" therebetween each of the plural pairs of flange members 18 to mount a series of mail boxes "M" therebetween. The spaced parallel rails 17 include an upper mounting plate 19 that includes an upper socket 19*a* orthogonally and fixedly mounted to the upper mounting plate 19 to receive the upper threaded end 13*a*.

FIG. 8 illustrates the use of a modified lower mounting plate 20, including corner openings 21 positioned at ninety degree intervals relative to one another orthogonally directed through the modified lower mounting plate 20, with each of the corner openings 21 defined by a first diameter and coaxially aligned with a corner support tube 22 that orthogonally and fixedly directs downwardly relative to the bottom surface of the plate 20. A spike member 23, including a spike head 24 defined by a second diameter greater than the first diameter, is slidably receivable through each of the corner openings 21 and associated support tubes 22 to permit initial positioning of the modified lower mounting plate 20 upon the ground surface and thereafter directing a spike member 23 through each of the openings 21 and associated tubes 22 for securing the organization to the ground surface. Alternatively, a modified spike 25 may be utilized, including a spike head 24, with a socket cavity 26 coaxially fixed into the spike head 24. The modified spike 25 includes an elongate shank, with an external thread 27 to permit rotative securement of the modified spike within an underlying ground surface or support.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A mail box support apparatus for securement of a mail box thereon, including an upper support plate, the upper support plate fixedly securing at least one mail box thereon, and the upper support plate including an internally threaded socket orthogonally and fixedly mounted medially to the bottom surface of the upper support plate, and a lower support plate, including a lower internally threaded socket medially and fixedly mounted to an upper surface of the lower support plate, with the lower socket orthogonally mounted thereon, and a post member, the post member including an upper threaded end and a lower threaded end, the upper threaded end threadedly received within the upper internally threaded socket, and the lower threaded end threadedly received within the lower threaded socket, and mounting means for securement of the lower support plate to an underlying ground surface, and wherein the mounting means include a plurality of spike members, each spike member mounted orthogonally relative to the lower support plate and oriented at ninety degree intervals about the support plate to include four spike members, and wherein the mounting means further includes a corner opening orthogonally directed through the support plate adjacent a circumferential periphery defined by the support plate, with each corner opening arranged ninety degrees relative to an adjacent corner opening to include four corner openings, and a corner support tube fixedly and orthogonally mounted to a bottom surface of the lower support plate coaxially aligned with each corner opening, and each corner opening defined by a first diameter, and each corner opening and corner support tube slidably receiving a spike member therethrough, and wherein each spike member includes a spike head fixedly mounted to an upper terminal end of each spike member, wherein the spike head is defined by a second diameter greater than the first diameter; and a lower terminal end defined by a pointed projection, and wherein each spike member includes a socket cavity coaxially directed through each spike head, and each spike member further includes an external thread formed integrally to an exterior surface of each spike, and wherein the upper mounting plate includes a plurality of spaced rails, and the spaced rails include plural pairs of "L" shaped flange members mounted thereon to permit securement of a mail box between each of the flange pairs.

* * * * *